US007244075B2

(12) United States Patent
Stadler

(10) Patent No.: US 7,244,075 B2
(45) Date of Patent: Jul. 17, 2007

(54) TELESCOPING BOLLARD WITH SCREW DRIVE

(76) Inventor: David M. Stadler, 28241 Santa Barbara, Lathrup Village, MI (US) 48076

( * ) Notice: Subject to any disclaimer, the term of this patent is extended or adjusted under 35 U.S.C. 154(b) by 15 days.

(21) Appl. No.: 11/197,693

(22) Filed: Aug. 4, 2005

(65) Prior Publication Data

US 2007/0031189 A1 Feb. 8, 2007

(51) Int. Cl.
*E01F 13/00* (2006.01)

(52) U.S. Cl. ..... 404/6; 49/131

(58) Field of Classification Search ..... 404/6, 404/9, 10; 49/49, 131
See application file for complete search history.

(56) References Cited

U.S. PATENT DOCUMENTS 3,086,430 A * 4/1963 Emmel ..... 404/6
3,771,488 A * 11/1973 Ecke ..... 114/218
4,635,492 A * 1/1987 Uebelhart ..... 74/89.35
4,919,563 A * 4/1990 Stice ..... 404/6
5,425,595 A * 6/1995 Roper ..... 404/9
6,626,606 B1 * 9/2003 Johnson ..... 404/6

FOREIGN PATENT DOCUMENTS

| | | |
|---|---|---|
| DE | 33 03 451 A1 | 8/1984 |
| DE | 199 55 052 A1 | 2/2001 |
| FR | 0 597 543 A1 | 5/1994 |
| FR | 2 743 097 | 12/1995 |
| GB | 2 372 065 | 1/2001 |
| WO | WO 00/79056 A1 | 12/2000 |

* cited by examiner

*Primary Examiner*—Gary S. Hartmann
(74) *Attorney, Agent, or Firm*—L.C. Begin & Associates, PLLC

(57) ABSTRACT

The present invention includes a bollard assembly 1 containing an an elongated housing 4. A bollard 2 is spaced radially inward of the housing 4 and is axially displaceable therein. A threaded drive shaft receiver 32 is centrally fixed within the housing 4 for threaded reception of a threaded drive shaft 30. The threaded drive shaft 30 is thereby suspended within the housing 4 and threadedly received by the receiver 32. Upon activation of the drive shaft 30 operably connected to the bollard 2, rotation of the drive shaft 30 establishes simultaneous vertical displacement of the drive shaft 30 and the bollard 2.

11 Claims, 7 Drawing Sheets

TELESCOPING BOLLARD WITH SCREW DRIVE

BACKGROUND OF THE INVENTION

A bollard is typically employed to prevent vehicular traffic inward or past the point of the bollard. Accordingly, any building or structure that requires protection may be protected by a plurality of bollards deployed about the periphery thereof. From a design standpoint, bollards must be strong enough to prevent and/or substantially slow movement of a vehicle between the bollard and the structure to be protected. Furthermore, periodically, vehicular access is desired and therefore the bollards must be designed in retractable fashion, thereby permitting vehicular travel over the recessed bollard.

Several retractable bollard designs are known and employ various deployment methods including hydraulic or pressurized gas means. Hydraulic bollards are disadvantaged by seals that sometimes deteriorate and result in a loss of hydraulic fluid pressure. On the other hand, bollards supported by gaseous pressure are disadvantaged by the loss of volume sometimes exhibited as ambient temperatures decrease. As with a loss of hydraulic pressure, the efficacy of the bollard comes into question as the supporting fluidic pressure is reduced. Furthermore, retractable bollards that function based on fluidic pressure must be maintained to ensure operability over extended periods of time.

SUMMARY OF THE INVENTION

A bollard assembly of the present invention addresses the concerns described above. A bollard is vertically extended or retracted by actuating a screw drive shaft. The shaft is supported by a tube or tower assembly that may represent a substantially concentric cross-section within a larger housing or tube having a larger circumference. The bollard is supported by a drive shaft receiver within a tower assembly, wherein the screw drive shaft is actuated either manually or by a motor. The screw drive shaft is equipped with a drive head that accommodates security requirements by providing a head design that only interfaces with a socket or wrench specifically designed to fit the unique head design of the drive head.

Stated another way, a bollard assembly of the present invention contains an elongated housing having a housing first end and a housing second end. A bollard is spaced radially inward of the housing and is substantially coextensive with the housing, the bollard being axially displaceable to extend from or retract within the housing. A tower is spaced radially inward of the bollard and extends within the housing for support of the bollard, the tower having a tower first end and a tower second end, and the tower fixed within the housing. A threaded receiver is fixed to the tower within the housing. A threaded drive shaft is suspended within the tower and is threadedly received by the threaded receiver for support of the drive shaft. A bollard carrier is fixed to the bollard at the housing first end, wherein the carrier is also fixed to the threaded drive shaft for support of the bollard upon vertical displacement of the bollard. Upon rotation of the threaded drive shaft, vertical displacement of the bollard is established as the threaded drive shaft and the bollard move in unison.

DETAILED DESCRIPTION OF THE PRESENT INVENTION

Figure 1:
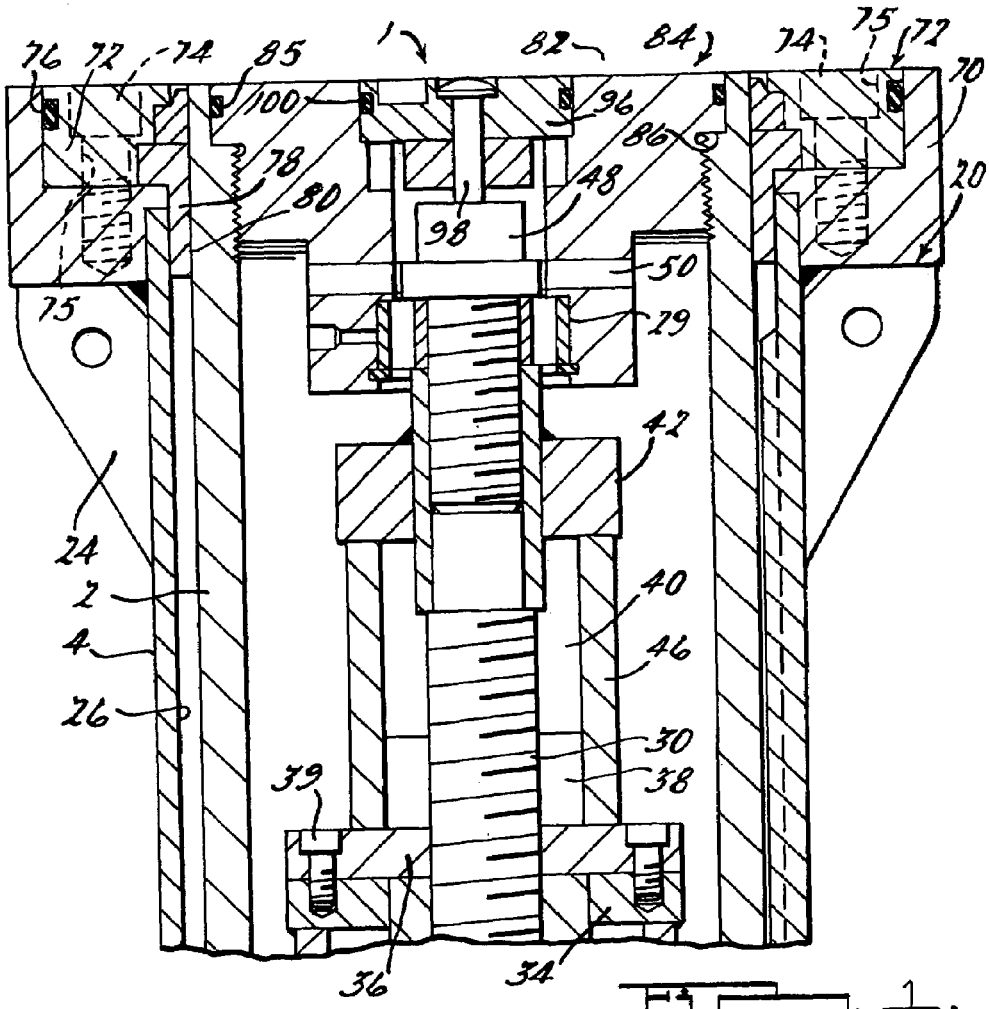
FIG. 1 is sectional view of a manually operated bollard assembly in accordance with the present invention.
Figure 2:
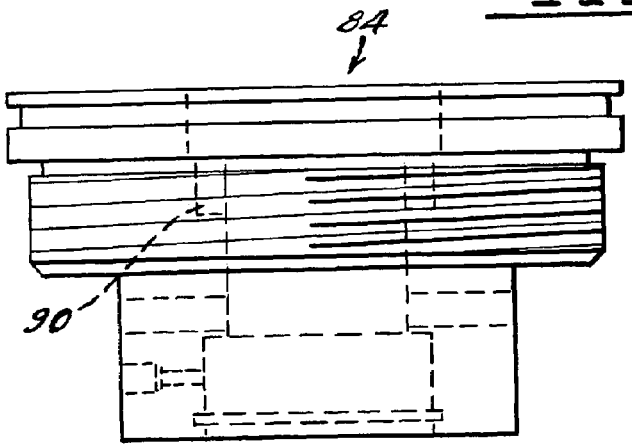
FIG. 2 is a sectional view and a side view of a bollard carrier in accordance with the present invention.
Figure 3A:
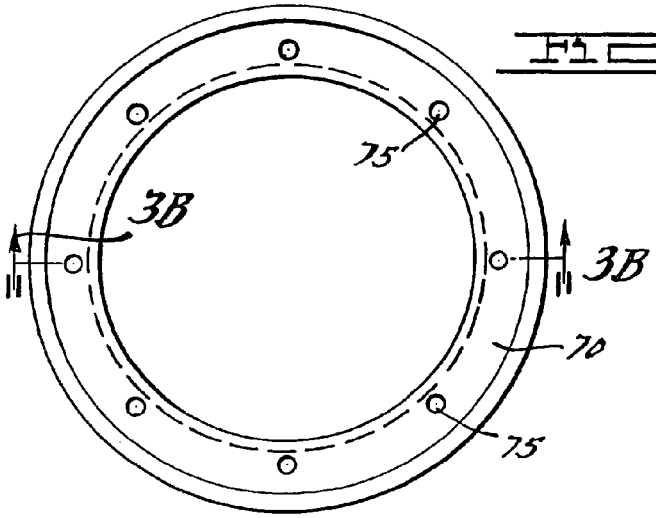
FIG. 3 is a top and side view of a bollard housing flange in accordance with the present invention.
Figure 3B:
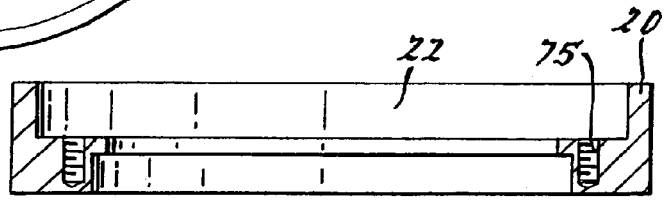
Figure 4A:
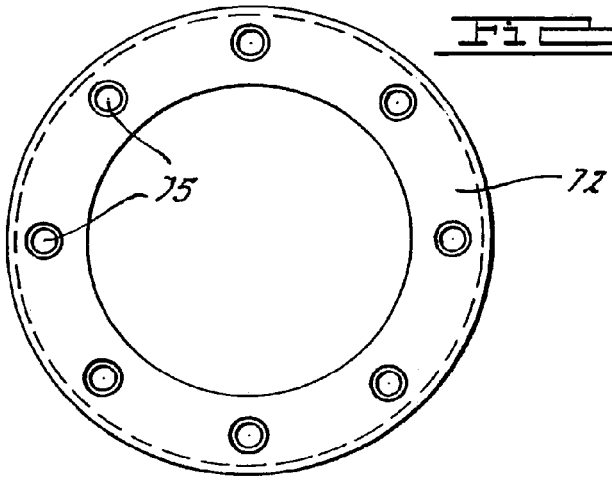
FIG. 4 is a top and side view of an access flange in accordance with the present invention.
Figure 4B:
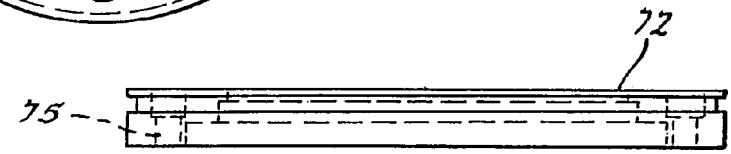

As shown in the figures, the present invention provides, in one embodiment, a bollard assembly 1 containing an improved retractable bollard 2 operable on a screw drive shaft. A bollard housing or tube 4 contains the bollard 2 for slidable and retractable engagement therein. The housing 4 contains a first end 6 and a second end 8. A tower assembly 10 is substantially concentrically disposed within the bollard housing 4 from the first end 6 to the second end 8, thereby providing a support or pedestal for the bollard 2. A tower tube 12 is substantially coextensive with the tower assembly 10 and connects a first tower assembly end 14 with a second tower assembly end 16.

A bollard housing base flange 18 is welded or otherwise fixed to the second end 8 of the housing 4 thereby providing a support base for the entire bollard assembly 1. If desired, the housing base flange 18 may include orifices for drainage of any moisture that accumulates within the bollard assembly 1. As described above, the tower tube 12 is welded or otherwise fixed to the base flange 18, at second end 8, thereby fixing the tower within the housing 4. A bollard housing flange 20 is welded or otherwise fixed to the first end 6 of the housing 4, thereby providing a compartment or recess 22 for packaging of upper members (further described below) of the bollard assembly 1. As shown in the figures, at least one lifting eye 24 and in the embodiment shown, a plurality of lifting eyes 24 may be welded or otherwise fixed to the base flange 18 and/or the bollard housing flange 20, thereby facilitating movement of the bollard assembly 1 by attachment to one or more of the lifting eyes 24.

An inner circumferential wall 26 of the housing 4 is defined by the housing 4, and is substantially coextensive with the bollard assembly 1. The bollard 2 is spaced radially inwardly of the inner wall 26. A compression spring 28 is spaced radially inwardly of the bollard 2 and substantially constrained along the length of the bollard 2 thereby supporting at least part of the load of the bollard 2 as it extends from the housing 4. The tower assembly 10 is spaced radially inwardly from the compression spring 28, or encased by the compression spring 28. As described below, a threaded drive shaft 30 is threadedly received within the tower assembly 10 thereby providing extension and retraction of the bollard 10. It will be appreciated that the drive shaft 30 is preferably, although not necessarily, threaded for most if not all of its length to facilitate a maximum height of the bollard 2 once it is fully extended. A thrust bearing 29 is shown as juxtaposed to the nut 48 as described herein. Stated another way, the thrust bearing 29 is located intermediate the nut 48 and the travel stop flange 42 thereby absorbing the axial load within the shaft 30.

A drive shaft receiver or receiver assembly 32 is fixed to the top end 14 of the tower assembly 10, and contains the constituents described immediately hereafter. An annular nut flange base 34 is welded or otherwise fixed near the tower end 14. An annular nut flange 36 is bolted to nut flange base 34 thereby providing a threaded female receiver for extension and retraction of the threaded drive shaft 30. Nut flange bolts 39 secure nut flange 36 against nut flange base 34. A nut 38 is fixed to nut flange 36 for threaded receipt of the drive shaft 30. Nut 38 may be fixed to nut flange 36 by threading the exterior as well as the interior of the nut 38, and providing a mated thread on the annulus of the nut flange 36. Nut 38 may then simply be threadedly received by nut flange 36. Other methods of fixing nut 38 to nut flange 36 known to those of ordinary skill are also contemplated. A lubricant reservoir 40 is positioned between the first end 14 of the tower 12 and the nut 38, in coaxial relation with the tower 12, wherein portions of the threaded drive shaft 30 traverse through the reservoir 40 prior to passing through the nut 38, thereby ensuring proper lubrication of the drive shaft as it is extended or retracted. A travel stop flange 42 is fixed at an upper end 44 of the drive shaft 30 to terminate movement of the drive shaft 30 once the flange 42 contacts the reservoir 40 during retraction of the bollard 2. A cylindrical spacer 46 rests upon nut flange 36 to locate the bollard 2 in the housing 4 against the stop flange 42.

A drive head 48 is integral to and fixed atop the drive shaft 30 thereby providing a manual means to drive the shaft, either by drill or by ratchet for example. The drive head 48 may be uniquely designed/machined to accommodate any desirable socket not commonly available to the general public. Accordingly, a mating socket for use with any suitable wrench is also manufactured as part of the overall bollard system. One or more vents 50 are juxtaposed to drive head 48, although the vents may be located in any other effective area, and are employed to vent air as it is displaced within bollard housing 4 during movement of the drive 30. The vents additionally function to provide conduits to the reservoir 40, thereby facilitating the replenishment of the lubricant within the reservoir 40, with lubricating compound for example, without requiring dismantling of the upper area of the bollard assembly 1.

Figure 12:
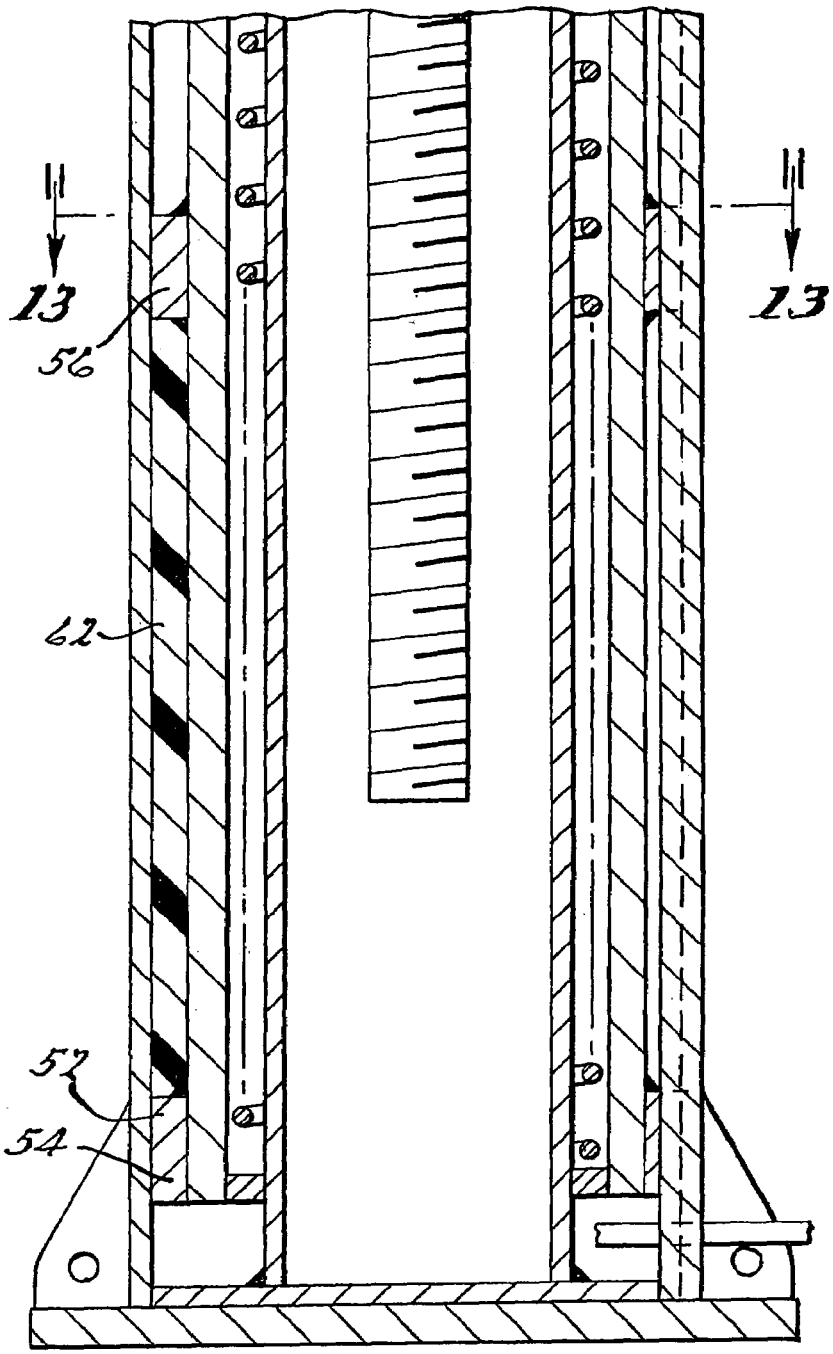
FIG. 12 is a sectional view of the lower end of the bollard assembly of FIG. 11.
Figure 13:
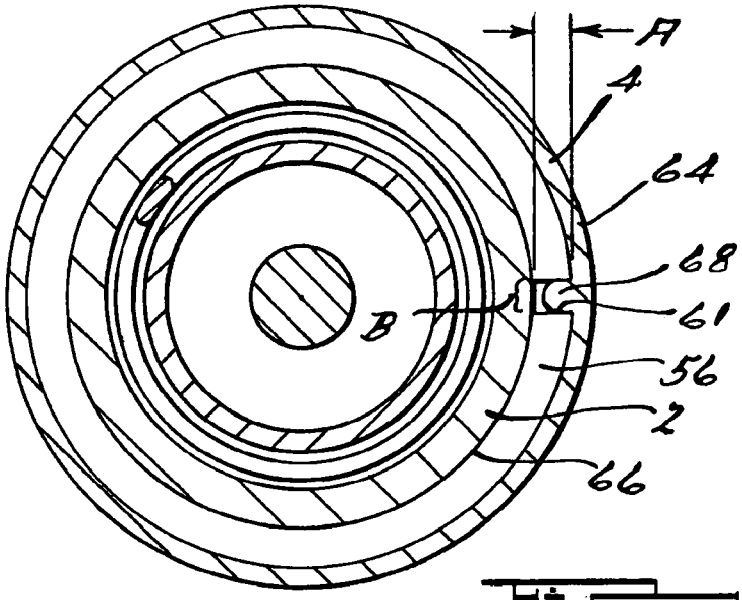
Figure 14:
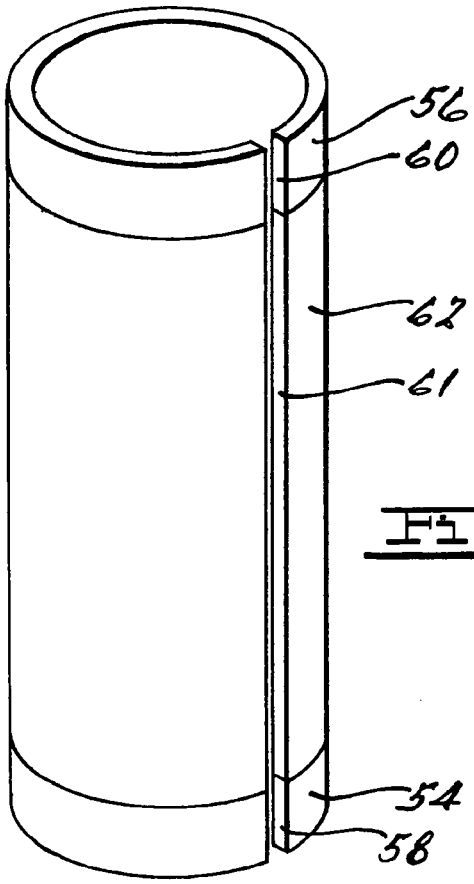

Again referring to the bollard 2, the bollard 2 is provided with several features thereby providing operable advantage as described below. As shown in FIGS. 12–14, a bottom end 52 of the bollard 2 is formed with a first guide ring 54 welded or otherwise fixed thereto, the first guide ring 54 having a diameter slightly larger than a majority of the bollard 2. A second guide ring 56, having substantially the same diameter as the first guide ring 54, is welded or otherwise fixed upwardly on the bollard 2, about one-third of its relative length. A first notch 58 is formed within the first ring 54, thereby providing a mate for an associated key described below. A second notch 60 is formed within the second ring 56, in linear relation with first notch 58 and substantially parallel to a longitudinal axis of assembly 1, whereby notches 58 and 60 are oriented in a substantially equivalent angular displacement about the circumference of bollard 2. A polymeric bushing or bearing 62 provides a shell about the bollard 2, albeit the shell is truncated at each point that each notch circumferentially begins and ends. Accordingly, a first half 64 of the bearing 62, and a second half 66 of the bearing 62, are mated together to form a bearing interface between the inner wall 26 and the bollard 2, with an arcuate length equal to that of each guide ring 54 and 56. The result is a linear arrangement of the notches 58 and 60 to provide a gap 61 formed between first and second halves 64 and 66, wherein the gap 61 has a radial length A and an arcuate length B.

A key 68 is formed along the length of the inner wall 26 and defines a linear ridge extending along the same arcuate orientation across the length of the bollard housing 4. It will be appreciated that the gap 61 and the key 68 mate to form a lock and key relationship whereby rotation of the bollard is thereby prevented. Stated another way, gap 61 and key 68 have substantially the same radial length A and substantially the same arcuate length B whereby mating of the two results in a bollard that moves in a vertical or axially parallel direction only.

Upper members of the bollard assembly 1 may be employed as in the following description. A housing flange 70 forms an upper periphery about the bollard assembly 1. An annular access flange 72 is fixed within recess 22 radially inward of housing flange 70, and provides a watertight seal about drive shaft receiver assembly 32 when combined with a cap as described below. The flange 72 represents the majority of the surface area of the bollard assembly 1. Accordingly, the top surface may be scored, etched, die-cast to form a pattern, or basically formed with a non-skid surface if desired. A plurality of tamper-proof bolts 74, again machined to complement a tool dedicated to remove the bolts 74, are used to fasten the access flange 72 within the compartment 22 and against the housing flange 70, thereby covering the receiver assembly 32. A plurality of orifices 75 are provided within flange 70 for receipt of a corresponding number of bolts 74. A first access flange seal or o-ring 76 may be employed about the periphery of the access flange 72, to seal the arcuate interface between the access flange 72 and the housing flange 70. A bollard bearing 78 is positioned radially inwardly of access flange 72, for guidance of bollard 2 as it extends or retracts within the housing 4. An annulus or bollard portal 80 within the annular access flange 72 fits flushly against the bollard 2 as it traverses therethrough, and permits passage of the bollard 2 as it is extended or retracted from the housing 4.

An upper area portion 82 of the bollard 2 is designed to provide functional access to the drive mechanism of the bollard assembly 1. As shown in the Figures, an annular carrier 84 is fit within the top of the bollard 2 and is substantially circumferentially coextensive with the bollard 2. The carrier 84 is fixed to the drive shaft 30 by a recess formed within the carrier that houses the top end of the drive shaft 30. An o-ring or seal 85 seals the interface between the carrier 84 and an inner wall of the bollard 2. An annular upper bollard flange 86 provides a pedestal on bollard 2 for flush communication with the carrier 84. A plurality of fasteners may be provided to fasten the carrier 84 against the bollard flange 86. A plurality of threaded orifices corresponding to the number of fasteners 88 may be provided for threaded receipt of the fasteners 88. A carrier annulus or recess 90 is defined within the annular carrier 84 for seating and operation of the drive shaft 30. The lock bolt or drive head 48 is integrally and operably connected to drive shaft 30 within the annulus 90, constituting the top of the drive shaft 30 for engagement with a complementary wrench. Furthermore, the drive head 48 basically forms an interference fit of sorts thereby retaining the drive shaft within the carrier 84 as the drive shaft is rotated to extend bollard 2, also connected to the carrier 84. It will be appreciated that with regard to security, the lock bolt 48 may feature a unique fit or pattern that is complemented by a corresponding wrench not available to the general public. As shown in the drawings, a cover or cap seal 96 is positioned over lock bolt 48, and when fastened in place by bolt 98, the drive head or lock bolt 48 is thereby provided with a watertight seal. A seal 100 surrounds the periphery of the cap 96 enhancing the seal of the cap 96.

Figure 9:
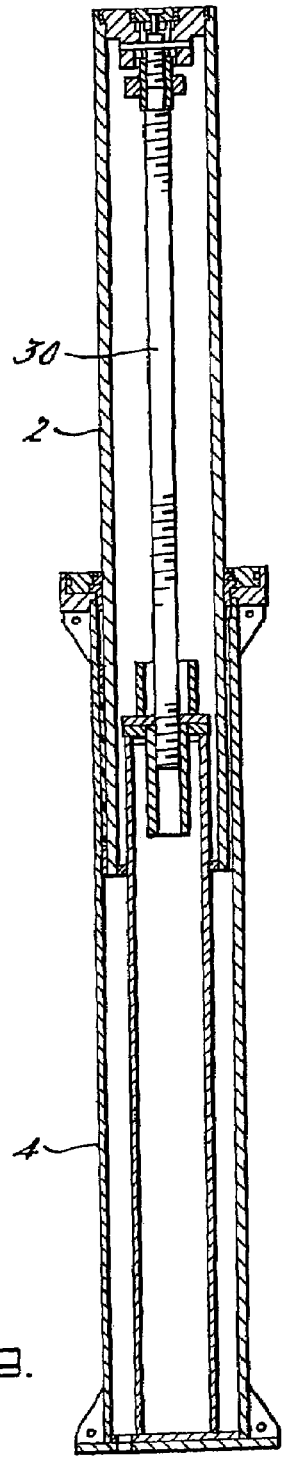
FIG. 9 is a sectional view of a bollard assembly having a bollard in an extended position.
Figure 10:
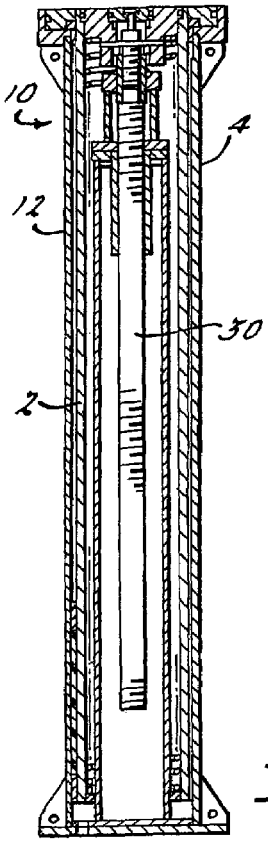
FIG. 10 is a sectional view of a bollard assembly having a bollard in a retracted position.

In operation, the bollard assembly 1 is installed to be level and flush with the substrate surrounding the assembly 1. Accordingly, typical substrates include black top or concrete. To extend the bollard 2, the cap 96 is removed to reveal drive head 48. Drive head 48 is engaged with a socket and wrench designed to fit the specific design of the drive head 48, as determined by customer requirements. The drive head 48 is rotated to upwardly extend the bollard 2, or if the bollard 2 is already extended, the drive head 48 may also be retracted to a position level with the road. As shown in FIGS. 9 and 10, the bollard 2 is carried upward in the housing 4 as the drive shaft 30 traverses upwardly through the receiver assembly 32. Stated another way, upon rotation of the drive nut 48, the bollard 2 is lifted as the drive shaft 30 is driven upwardly through the bollard portal 80 along with the bollard 2.

Figure 11:
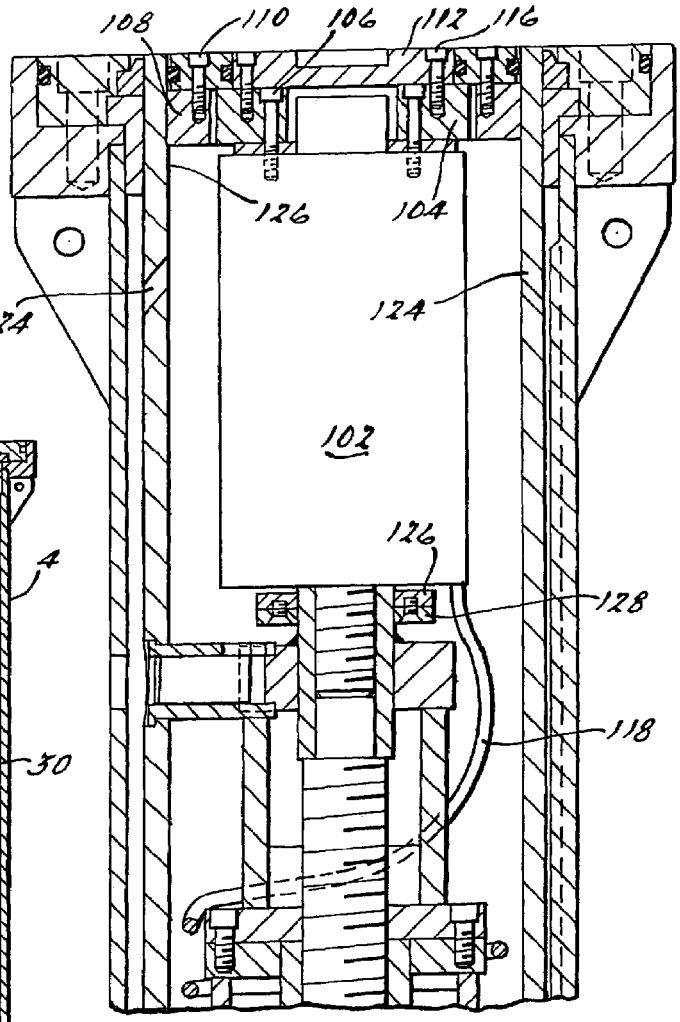
FIG. 11 is a sectional view of a motor driven bollard assembly in accordance with the present invention.

In another embodiment shown in FIG. 11, an optional reversible electric motor 102 (schematically represented) may be bolted to a carrier flange 104. A first plurality of carrier bolts 106 are threadedly received through a corresponding number of holes in the carrier flange 104, and then threadedly received within the housing of the motor 102. An annular motor mount 108 is welded or otherwise fixed to the inside wall 26 of the bollard 2. A second plurality of carrier bolts 110 are threadedly received through a corresponding number of holes in the carrier flange 104, and then threadedly received within the motor mount 108 for additional support of the motor 102. Emergency cap 112, fit within a recess 114 within the carrier flange 104, may be removed in the event of a power failure where bollard access 2 is required. Accordingly, at least one bolt 116 is employed to fasten cap 112 to the carrier flange 104. It will be appreciated that other features numbered as in the first embodiment essentially function in the same way unless otherwise indicated. A power cord 118 is coiled about tower 12 and is then routed from the bollard assembly 1 to a conduit tube 120 leading to a control box (not shown). If desired, the controls to the motor 102 may be programmed to work only when an access code is determined via radio frequency identification or any other type of electronic and/or remote identification, for example. A first coupler flange 126 is located on the motor armature shaft and is bolted to a second coupler flange 128 for translation of energy from the motor 102 to the drive shaft 30.

Any embodiment of the present invention may optionally employ a radio frequency identification device 122 for access and/or identification of a breach of the cover 96, 112 of the bollard assembly 1. Radio frequency identification provides ongoing transmission and reception of a signal that when interrupted indicates a breach of the bollard assembly 1. Further, as shown in FIG. 11, vents 124 may be arranged in an oblique fashion along the sides of housing 4 within the bollard 2, thereby venting air displaced during operation of the bollard 2. The wire conduit 120 may also be utilized to vent the air displaced during operation of the bollard assembly 1. In any embodiment, removal of the cap or cover 96, 112 provides access to the drive head 48 whereby a drill with the properly designed socket may be employed to deploy the bollard 2 in a matter of seconds.

An optional abrasive liner 130 may be fixed between the outside diameter of the tower 12 and the compression spring 28, thereby inhibiting penetration of the bollard 2, by a saw for example. The liner may be made from hardened steel or any other hardened and/or abrasive material in a known manner.

Figure 7:
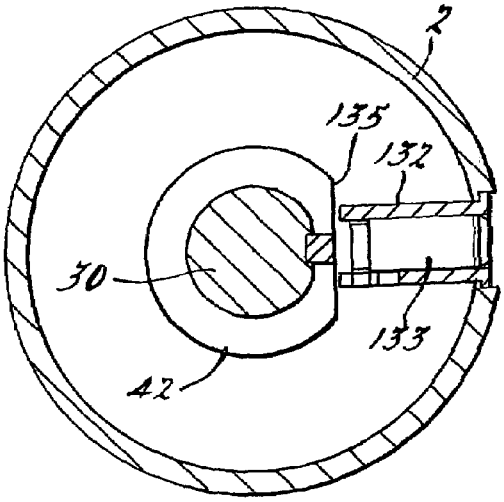
FIG. 7 is a sectional view of a travel stop flange having a cylindrical lock placed proximate to a flat of the travel stop flange.
Figure 8:
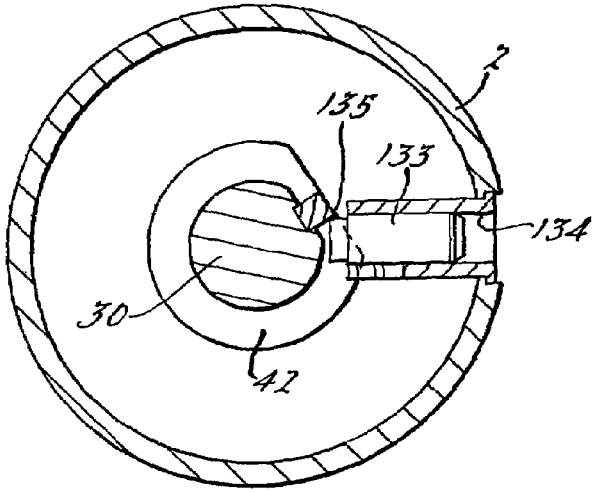
FIG. 8 is a sectional view illustrating the prevention of rotation of the travel stop flange when engaged with the cylindrical lock.

As shown in FIGS. 7 and 8, an optional manual cylindrical keyed lock 132 extends radially inwardly through the bollard 2, whereby a lock cylinder 133 extends into a flat 135 of the travel stop flange 42. This aspect of the invention may be employed to provide additional security relative to a manually operated bollard assembly 1, that is one driven by a drill or hand operated wrench. A first locking orifice 134 is provided in the housing 4, for passage of the lock 132. A second locking orifice 136 is provided in tower 12, in coaxial relation to the first orifice 134, for passage of the lock 132. When implemented, the stop flange 42 is prevented from rotation by interference with the flat 135 and the cylinder 133. Accordingly, drive shaft 30, fixed to flange 42, is also prevented from rotating and therefore unauthorized retraction of the bollard 2 is inhibited. See FIG. 8 illustrating the same.

The structure described above is formed from metallic components. The metallic components of the present invention may be die-cast, machined, or otherwise metal-formed as known in the art. The size of the bollard assembly 1 and the relative sizes of the associated components may be varied and determined as per design requirements. The motor 102 and the attached circuitry, including the radio frequency identification circuitry, may be provided by known suppliers, or manufactured in a known manner. Metallic components of the present invention may also be interchanged with polymeric or tough composite materials so long as the material is suitably tough for the respective function served.

Figure 5:
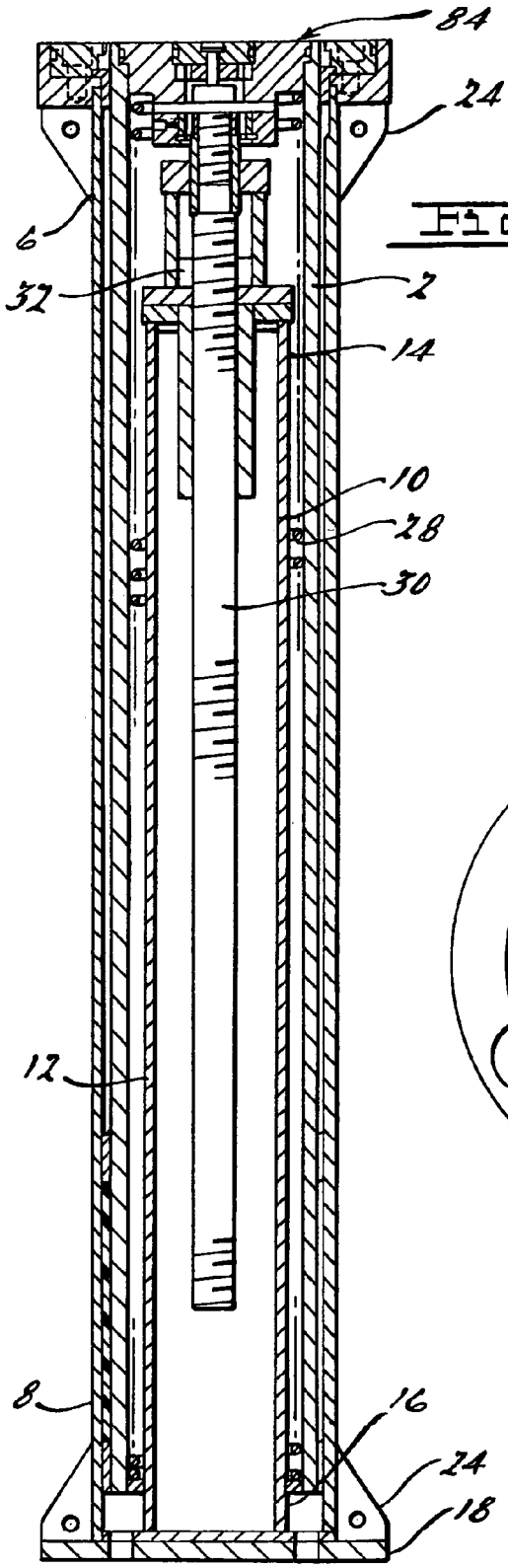
FIG. 5 illustrates a bollard assembly containing a compressed spring for support of a bollard.
Figure 6:
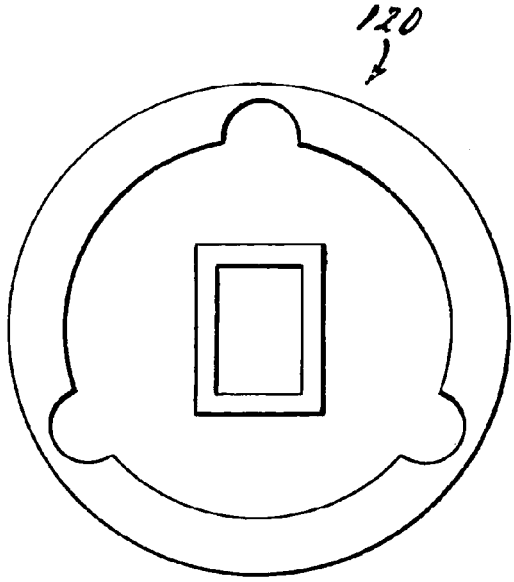
FIG. 6 is a top view of a socket designed to fit a drive shaft drive head in accordance with the present invention.

In yet another aspect of the invention, as shown in FIG. 6, a bollard system as described above includes a socket or tool 120. As further shown in the figures, a plurality of slots 121 are defined within the carrier 84 and mate with the tool 120 to remove the carrier 84 from the top of the bollard 2. As shown in FIG. 5, the carrier 84 may be threadedly received within the bollard 2. Tool 120 is designed to complement the placement of the slots 121 within the carrier 84. Accordingly, as shown in FIG. 6, the tool 120 may complement a carrier 84 having three slots spaced 115 degrees, 118 degrees, and 127 degrees of arcuate length from an adjoining slot.

In sum, the present invention includes a bollard assembly containing an an elongated housing; a bollard spaced radially inward of the housing and axially displaceable therein; a threaded drive shaft receiver centrally fixed within the housing for threaded reception of a threaded drive shaft; and a threaded drive shaft suspended within the housing and threadedly received by the receiver, the drive shaft operably connected to the bollard, whereby rotation of the drive shaft establishes vertical displacement of the drive shaft and the bollard.

It will be understood that the foregoing description of an embodiment of the present invention is for illustrative purposes only. As such, the various structural and operational features herein disclosed are susceptible to a number of modifications commensurate with the abilities of one of ordinary skill in the art, none of which departs from the scope of the present invention as defined in the appended claims.

What is claimed is:

1. A bollard assembly comprising:

an elongated housing having a housing first end and a housing second end;

a bollard spaced radially inward of said housing and substantially coextensive with said housing, said bollard axially displaceable;

a tower spaced radially inward of said bollard and extending within the housing for support of said bollard, said tower having a tower first end and a tower second end, said tower fixed within said housing;

a threaded receiver fixed to said tower;

a threaded drive shaft suspended within said tower and threadedly received by said threaded receiver for support of said drive shaft and vertical displacement thereof; and a carrier fixed to said bollard at said housing first end, said carrier also fixed to said threaded drive shaft for support of said bollard upon vertical displacement of the bollard, wherein rotation of said threaded drive shaft establishes vertical displacement of said bollard as the threaded drive shaft and the bollard move in unison.

2. The bollard assembly of claim 1 wherein the housing and the tower define respective housing and tower cross-sections, said cross-sections defining substantially concentric circles.

3. The bollard assembly of claim 1 wherein said threaded receiver comprises:

an annular nut flange base fixed to the tower, said annular nut flange base defining a first annulus;

an annular nut flange fixed to the annular nut flange base, said annular nut flange defining a second annulus; and an annular nut comprising a threaded annulus, said annular nut fixed to said annular nut flange, wherein said threaded drive shaft is extendable or retractable through the first, second, and threaded annuli.

4. The bollard assembly of claim 1 further comprising a compression spring encased about said tower, said spring further supporting said bollard upon axial displacement thereof.

5. The bollard assembly of claim 1 further comprising a drive head integral to the drive shaft at a top end thereof, said drive head recessed within said carrier at said first end of said housing, wherein said drive head is manually or machine driven to establish rotation of said drive shaft and vertical displacement of said bollard.

6. The bollard assembly of claim 5, wherein a periphery of said drive head is formed in a non-conventional manner thereby providing a security advantage.

7. The bollard assembly of claim 6 further comprising a special tool formed to complement the periphery of said drive head, thereby facilitating rotation of said drive head.

8. The bollard assembly of claim 1 further comprising:

a travel stop flange fixed to the threaded drive shaft proximate a top of the drive shaft, said travel stop flange preventing further vertical displacement of the bollard and the threaded drive shaft upon retraction of said bollard once the bollard is at least substantially flush with the first end of the housing.

9. The bollard assembly of claim 8 further comprising:

a flat portion about the periphery of said travel stop flange; and a lock extending radially inwardly through said housing and proximate to said flat portion, wherein said lock prevents rotation of said threaded drive shaft by impingement of said flat portion against said lock.

10. The bollard assembly of claim 1 wherein said carrier is substantially circumferentially coextensive with said bollard.

11. A bollard assembly having a rotational axis along a length thereof, said bollard assembly comprising:

an elongated housing and an inner wall defined by said housing;

a bollard spaced radially inward of said housing and axially displaceable therein;

a threaded drive shaft receiver centrally fixed within said housing for threaded reception of a threaded drive shaft; and a threaded drive shaft suspended within said housing and threadedly received by said receiver, said drive shaft operably connected to said bollard, whereby rotation of said drive shaft establishes vertical displacement of said drive shaft and said bollard;

a longitudinal ridge extending along said inner wall parallel to said axis of said bollard assembly and substantially coextensive with said housing, said ridge defining a key having an arcuate length and a radial length;

at least one guide ring circumferentially fixed about said bollard, said guide ring having a radial length at least substantially equivalent to the radial length of said key;

a notch defined in said guide ring, said notch defined by an absence of the guide ring about said bollard and said notch having an arcuate length at least substantially equivalent to said key;

a bearing assembly substantially circumferentially disposed about said bollard at said second end of said housing and constrained by said guide ring, said bearing assembly slidably engaged with said inner wall upon vertical displacement of said bollard; and a gap defined across the length of said bearing assembly and parallel to said axis, said gap having an arcuate and radial length substantially equivalent to said key;

wherein upon rotation of said drive shaft, the bollard is vertically displaced in unison with the vertical shaft but substantial rotational displacement of the bollard is prevented.

* * * * *